US006379136B1

(12) United States Patent
Najour et al.

(10) Patent No.: US 6,379,136 B1
(45) Date of Patent: Apr. 30, 2002

(54) APPARATUS FOR PRODUCTION OF SUB-DENIER SPUNBOND NONWOVENS

(76) Inventors: Gerald C. Najour, 6456 Rosecommon Dr., Norcross, GA (US) 30092; Gregory F. Ward, 11115 Rotherick Dr., Alpharetta, GA (US) 30022

( * ) Notice: Subject to any disclaimer, the term of this patent is extended or adjusted under 35 U.S.C. 154(b) by 0 days.

(21) Appl. No.: 09/328,953

(22) Filed: Jun. 9, 1999

(51) Int. Cl.[7] ..... D01D 5/092; D01D 5/098

(52) U.S. Cl. ..... 425/66; 425/72.2; 425/83.1; 425/463

(58) Field of Search ..... 425/66, 83.1, 72.2, 425/463, 464

(56) References Cited

U.S. PATENT DOCUMENTS

| | | | | | |
|---|---|---|---|---|---|
| 3,929,542 | A | * | 12/1975 | Gehrig et al. | 425/72.2 |
| 4,820,142 | A | * | 4/1989 | Balk | 425/72.2 |
| 5,460,500 | A | * | 10/1995 | Geus et al. | 425/72.2 |
| 5,503,784 | A | * | 4/1996 | Balk | |
| 5,702,730 | A | * | 12/1997 | Reifenhauser et al. | 425/72.2 |
| 5,766,646 | A | * | 6/1998 | Geus et al. | 425/72.2 |
| 5,814,349 | A | * | 9/1998 | Geus et al. | 425/72.2 |
| 5,820,888 | A | * | 10/1998 | Geus et al. | 425/72.2 |
| 5,935,512 | A | * | 8/1999 | Haynes et al. | 425/72.2 |
| 5,968,557 | A | * | 10/1999 | Weger et al. | 425/72.2 |

* cited by examiner

*Primary Examiner*—Nam Nguyen
*Assistant Examiner*—Joseph Leyson

(57) ABSTRACT

A unique isotropic sub-denier spunbond nonwoven product created by an apparatus comprising a unique multi-head resin metering system, a spinneret head with spinning sections, separated by a quench fluid extraction zone, a two sided, multilevel quench system, a fluid volume control infuser system which automatically guides the filaments into the filament drawing system while conserving energy by using a portion of the quench fluid as part of the drawing fluid and also minimizing turbulence at the entrance to the draw slot. The filament drawing system comprises a draw jet assembly with adjustable primary and secondary jet-nozzles and a variable width draw jet-slot. The entire draw jet assembly is moveable vertically for filament optimization. The offset, constant flow secondary jet-nozzle system provides an unexpectedly high velocity increment to the filaments by oscillating the filaments and increasing their drag resulting in remarkably low fiber denier on the order of 0.5 to 1.2. The apparatus also embodies a draw jet extension with an adjustable slot and contains two in-line or tandem which are also adjustable and maintain fiber tension and draw force through the lower end of the draw system. Drawn filaments are decelerated in an adjustable fluid volume control diffuser system which controls the amount and pressure of fluid in the diffuser and controls turbulence. The filaments enter into the fluid control system and begin to describe a downward spiraling motion results in remarkably uniform isotropic web where the machine to cross direction ratios of the bonded web physical properties such as tensile strength and elongation approach a ratio of 1:1.

18 Claims, 6 Drawing Sheets

APPARATUS FOR PRODUCTION OF SUB-DENIER SPUNBOND NONWOVENS

BACKGROUND OF THE INVENTION

1. Field of the Invention

This invention relates to a new sub-denier spunbonded nonwoven web product produced by a unique spunbond apparatus and its unique operating process for the continuous production of thermoplastic synthetic resin filaments at unusually high filament speeds. More particularly the invention relates to the production of such nonwoven webs by this spunbond apparatus utilizing extremely high fiber speeds, generally of the order of 80 m/sec and more typically exceeding 100 m/sec. resulting in fibers on the order of 1.0 denier and less. In another important aspect, the invention relates to a nonwoven fabric possessing a more uniformly random web structure with sub-denier fibers created by the inventive apparatus and method. This web structure results in a narrower ratio of machine direction to cross direction tensile properties in addition to significantly improved cover and greater opacity.

2. Prior Art

It is well known to produce nonwoven webs from thermoplastic materials by extruding the thermoplastic material through a spinneret and drawing the extruded material into filaments by eduction to form a random web on a collecting surface. U.S. Pat. No. 3,802,817 to Matsuki et al describes a full width eductor device and method which requires high pressures, however it is limited to lower speeds for practical operation. U.S. Pat. No. 4,064,605 to Akiyama et al similarly describes apparatus employing high speed air jet drafting with the same inherent limitations. U.S. Pat. No. 5,292,239 to Zeldin et al discloses a device that significantly reduces turbulence in the fluid flow in order to uniformly and consistently apply the drawing force to the filaments, which results in a uniform and predictable draw of the filaments. This system limits the magnitude of attenuation because of insufficient draw forces due to the extremely shallow jet angle. U.S. Pat. No. 5,814,349 to Geus et al discloses a device which combines quench fluid flow with below the belt suction. However, this arrangement requires a decoupling device in order to prevent skein forming deceleration which negates the original advantages of the U. S. Pat. No. 5,032,329 to Reifenhauser.

Polypropylene is the only thermoplastic resin that is commonly utilized in conventional air drawn spunbond processes. It is important to note that due to the limitations of existing spunbond spinning systems it is virtually impossible to process resin entities in equipment designed for polypropylene where flow and spinning characteristics deviate significantly from polypropylene.

As a first step, the resin is melted and extruded through a spinneret to form a vertically oriented cascade of downwardly advancing molten fibers. The filaments are fluid cooled to quench and uniformly cool the filament curtains for optimum drawing and development of the desired high crystallinity which provides the goal of high fiber strength. A fiber drawing system having a fluid draw jet-slot, into which a controlled volume of high velocity fluid is introduced, draws additional fluid into the upper open end of the drawing slot and creates a rapidly moving downstream of fluid within the slot. This fluid stream creates a contiguous drawing force on the filaments, causing them to be attenuated. After the filaments are attenuated they exit the bottom of the slot where they are deposited on a moving conveyor belt to form a continuous web of the filaments. The filaments of the web are then joined to each other through conventional calendering and point bonding techniques.

Forming filaments in the well known conventional spunbond systems results typically in filaments of 2.5 denier to 12 denier and higher. Using conventional methods, the molten filaments leaving the spinneret typically are immediately cooled at their surfaces to ambient temperature and then subjected to the typical drawing system. This conventional method and apparatus produce adequate non-woven fabrics however their properties, especially tensile strength, high machine direction to cross direction strength ratio, non-chemically enhanced hydrophobicity, drape, softness and opacity are poor.

When conventional spunbond systems attempt to make sub-denier fiber the resin output per hole drops precipitously reducing spunbond fabric production to less than half of the production when forming spunbond of typical denier range.

The instant invention through the use of a unique new apparatus and process, provides a greatly improved spunbond fabric consisting of a narrow range of low denier filaments which improves all of the aforementioned properties.

The low-denier filaments with their smaller diameter produces more surface area and more length per unit weight, reduces light transmission and improves light dispersion (greater opacity) and softness (lower unit fiber deflection forces). Using the instant invention spunbonded fabrics can be made from a wide range of resins, in addition to polypropylene, such as polyethylene, polyester, polyamides, polycarbonate, polyphenylene sulfide, liquid crystal polymers, fluropolymers, polysulfone and their copolymers as well as other extrudable synthetic resins. Providing narrow ranges of filament sizes from 0.1 denier to 1.0 denier with a wide range of polymers is extremely desirable because of their improved performance properties as indicated above. A further process benefit of the instant invention is that resin throughput per hole per minute is not reduced below existing commercial rates.

Examples of end uses for the instant invention are filtration materials, diaper covers and medical and personal hygiene products requiring liquid and particulate barriers that are breathable and provide good vapor transport with significant air permeability. Because of the low denier the spunbond fabrics produced by the instant invention have physical and performance properties comparable to SMS (Spunbond-Meltblown-Spunbond), SMMS (Spunbond-Meltblown- Meltblown-Spunbond) and SM (Spunbond-Meltblown) fabrics. This is an important result since it suggests that a single die head or beam can produce a material which now requires from two to four die beams.

Prior conventional spunbond art is almost completely concerned with the use of polypropylene. An important limitation of prior art is the inadequacy of conventional spunbond systems to extrude and highly draw common resins such as polyester, polyethylene or more unusual resins such as polyamides, polycarbonate, polysulfone and polytetrafluoroethylene.

The instant invention teaches apparatus and processes that are designed with intrinsic accommodations to extrude and draw fibers with an extreme range of extrusion temperatures, wide variations in glass transition temperatures, wide ranges of melt viscosities and other variable resin properties important to filament extrusion, forming, quenching and drawing, thereby widening the application of the spunbond arts.

Objects Of The Invention

It is the principal object of the present invention to provide an improved system for the production of spunbonded nonwoven webs of thermoplastic synthetic resin filament which allows:

1. significant increase in filament velocity and attenuation over a wide range of filament diameters.
2. significant decrease in fiber denier or diameter at lower operating costs without sacrificing mass through-put.
3. capability of spunbonding a wide variety of resins using one apparatus having a wide degree of adjustment in the extrusion, forming, quenching, drawing and lay-down operations.
4. stronger fibers through improved crystallization kinetics based on improved attenuation and quench control.
5. higher nonwoven fabric opacity and cover.
6. increased fiber and nonwoven fabric uniformity (narrower filament diameter range).
7. significant increase in collector speeds with resultant higher mass throughput.
8. production of webs with filament deniers of less than 1.0.
9. production of light weight webs at collector speeds in excess of 600 meters per minute.
10. production of nonwoven material at mass rates of greater than 400 to 600 kg/hr/meter of die width.
11. Filament spinning speed of greater than or equal to 7000 meters/minute.

More specifically, it is an object of the invention to improve a spun-bond apparatus so that the throughput of the synthetic resin filament is increased and the production rate enhanced without encountering drawbacks typically found in spunbond apparatus such as excessive energy consumption and poor web uniformity.

Other important objects of the invention are to provide:

1. an improved method of operating a spunbond apparatus to eliminate drawbacks thereof by increasing the degree of attenuation while decreasing the filament denier at relatively low energy cost with a minimum of process complexity.
2. an improved method of feeding precise amounts of resin to each orifice in the spinnerets using multiple feeding mechanisms.
3. an improved filament extrusion die with the capability of containing a greater number of extrusion orifices per meter of die width and length. an improved apparatus for the purposes described which allows the operating conditions within the apparatus to be varied in a sufficiently wide range of relationships to accommodate a large variety of resin materials and for the production of a wide range of products without the limitations characterizing earlier and present spunbond production systems.
4. improved quenching performance and uniformity by precise control of fluid temperature and velocity in a plurality of descending zones of the quench fluid system.
5. an improved apparatus including a fluid inlet infuser, a draw jet-slot, a draw jet-nozzle, a venturis, and a outlet fluid diffuser which are independently adjustable to provide optimum process control over a broad range of resins.
6. an improved apparatus and process which increases the drag force on fibers by inducing a controlled sinusoidal fiber track which permits the fiber velocity to be increased by increasing the area of fiber exposed to the drafting fluid drag forces thus significantly reducing the filament denier and decreasing energy requirements.
7. an improved apparatus and process which provides controls induction of fluid into the draw jet slot extension below the venturi to induce mini-vortices at the walls and provide a turbulent boundary layer.
8. improved uniformity of filament laydown by controlled turbulent separation of the fiber cascade at the entrance to the lower adjustable fluid volume control diffuser.
9. an improved method of making nonwoven webs of synthetic resin filaments whereby drawbacks of earlier and present conventional spunbond systems, especially limitations on draw force, fiber velocity, fiber formation and web collector speed are eliminated.

All of the aforementioned process and product improvements are an integral result of the system which is presented below.

SUMMARY OF THE INVENTION

An apparatus for the production of sub-denier spunbonded nonwoven fabrics has, according to the invention, a resin extrusion device, a unique multi-head metering system for micro-metering resin to micro-distributors in the spinnerets, a spinneret die head with dual front and back perforated spinning sections, separated by a buffer section or quench fluid extraction zone having a lower density of perforations and in some embodiments no perforations, wherein the buffer section allows full and uniform penetration of quench fluid, for extruding a multiplicity of continuous thermoplastic strands that then descend through a two sided, multilevel quench system and thence through a fluid volume control infuser system, which meters quench fluid into or, if required by the process conditions, out of the filament drawing system.

The quench fluid is supplied from a blower through one or more heat exchangers into a controlled three level manifold which permits flow rate and temperatures to be controlled independently into each segment of the quench cabinet.

The dual spinning sections with the unique buffer zone or quench fluid extraction zone located between the two outside spinning sections is a very important part of the instant invention because it permits the use of more spinneret orifices per meter of width than can be accomplished in conventional systems. This is accomplished by using a high density of orifices in the two outside spinning sections and a central fluid buffer zone or quench fluid extraction zone located between the two outside spinning sections. Experimentation with the design of the buffer zone indicated that it could also be used for the production of additional filaments without creating a disturbance in the filaments at the point of the two streams' impingement. We further found when the filament density, or orifice density, was about eighty percent or less of the filament density of the dual spinning sections that impingement of the opposing fluid streams in the buffer zone was not an issue. Consequently the central buffer zone may contain a reduced density of perforations, or in some embodiments, a zero density of perforations.

This overcomes the necessity to significantly reduce resin flow per hole per minute which is the main drawback in producing low or sub-denier fibers at commercially acceptable rates. The end result of the flow reduction is that low denier fiber production is always reduced far below commercial expectations. Furthermore, inadequate control of the quench process results in ineffective drawing with resultant non-uniform and weak fibers.

The bilateral nature of the split array orifice spinnerets with an independently controlled bilateral quench system also permits the use of two different but compatible resins, one on each side, or a differentially quenched bicomponent filament.

The filament cascade is automatically guided into the filament drawing system by the fluid volume control infuser system which depends from the lower surface of the quench assembly and is extensibly attached to the draw jet assembly. The purpose of the fluid volume control infuser system is to conserve energy by using a portion of the quench fluid as part of the drawing fluid and simultaneously minimizing turbulence at the entrance to the draw slot thus providing a uniform cascade of filaments to the drawing step. This arrangement provides a self feeding action for the descending cascade of filaments and is extremely important from an operational standpoint.

The fluid volume control infuser system consists of two perforated plates oppositely situated and variable, as to angle, open area and vertical length, each containing a multiplicity of uniquely shaped and oriented perforations to permit two-way fluid flow. Further, the open area of the multiplicity of fluid holes is controllable as to area by use of a slide gate or similar fluid volume control means. The holes or amount of open area controls the amount and pressure of fluid in the infuser and controls turbulence but allows the fluid to be automatically bled off or entrained.

When quench fluid, descending from buffer zone, is drawn into the fluid volume control system infuser by its downward velocity and the suction developed at the inlet of the draw jet slot opening by the draw jet flow an over-pressure condition may occur which may cause turbulence at the slot inlet. The combination of the fluid scoop shape and the open area of the infuser plates permits the automatic shedding of excess fluid and the balancing of pressures as the fluid and filament velocities increase into the slot. The variable area permits the specific adjustment for different resin species where the quench fluid may be very high or low in volume and velocity. The major axis length of the perforated holes ranges from 20 millimeters to 150 millimeters. Each row may have different sized holes. The fluid scoop portion of the hole is elevated above the outer surface of the infuser plate.

The infuser plates have a sliding means in their lower portion which permits the distance between the lower edge of the quench system and the upper surface of the draw jet assembly to be adjusted to required process conditions for different resin species.

The filament drawing system consists of a draw jet assembly that contains a variable width draw jet-slot and variable width draw jet-nozzle. The assembly consists of a right and a left hand vertical halves. The right and left hand vertical halves are moveable horizontally in relation to each other. The entire draw jet assembly is moveable vertically in order to optimize the distance between the draw jet-slot and the emerging filaments at the spinnerets.

The space between the left and right vertical halves defines the variable width slot used to vary drawing velocity. The upper surface of both the right and left hand halves of the assembly contains an adjustable nozzle plate that is moveable horizontally in relation to the slot wall and serves to define the variable width draw jet-nozzle outlet passage and thus adjusts the draw jet fluid velocity. The angle formed by the centerline of the primary jet-nozzle and the centerline of the draw jet-slot ranges from 2 degrees to 45 degrees. The slot extends vertically to the draw jet extension and horizontally the width of the spinneret head. The draw jet-nozzles formed by the adjustable nozzle plate and the upper edge of the vertical halves provide motive fluid for the drawing process, extend the full horizontal width of the jet-slot.

Experimentation showed that when the two horizontally opposed and adjustable draw jet-nozzles are offset vertically by a centerline distance of from 1 millimeter to 50 millimeters the draw force is still very high but, surprisingly, a vertical sinusoidal oscillation is created in the descending cascade of filaments. The filaments produced with this innovation were significantly finer than when the jet-nozzles were directly opposed and not offset. The oscillation produces a higher filament drag coefficient and thus increase the energy transfer coefficient between the filaments and the draw jet fluid stream thereby increasing the fiber attenuation.

Further experimentation showed that this oscillation could also be produced by several alternative methods. When a second set of adjustable gap jet-nozzles are located in the slot wall on each side of the left and right hand assembly halves and below the primary draw jet-nozzles, and when these secondary jet-nozzles are directly opposed and not offset, and are provided with a system that emits pulses of fluid at a fixed angle across the slot alternately from each side these secondary jet-nozzles also create a small sinusoidal oscillation in the filament cascade which provides a larger drag area for the motive fluid to impact and to accelerate the individual filaments. The angle formed by the center line of the secondary jet-nozzles and the centerline of the draw jet-slot ranges from 2 degrees to 45 degrees. The increased drag coefficient also provides a more efficient transfer of energy to the filaments. The secondary jet-nozzle may also suck fluid out of the draw jet-slot in the same alternating pulsation mode. It was also discovered that off-set pulsating jets also produced the required oscillations.

Experimentation has also shown that the filaments may also be oscillated by a constant or intermittent flow from only one side. It was eventually discovered that the secondary jet-nozzle system worked best when they were offset and the flow was constant from each side. It was discovered that in the primary jet plus secondary jet configuration the additional fluid flow together with improved drag factor from the oscillation effect added an unexpectedly high velocity increment to the filament curtain which resulted in remarkably low fiber diameters which were in the 0.5 denier to 1.2 denier range depending on the system configuration. Adjustable gap secondary draw jet-nozzles were also evaluated and determined to provide even better control of denier. Both the primary and secondary jets are preceded by a full die width pressure equalization and distribution system.

Below and attached to the lower half of the draw jet assembly is a supplemental acceleration device or draw jet slot extension, which has a horizontally adjustable slot similar to the draw jet assembly slot but which is also vertically adjustable and contains two in-line or tandem venturis or other fluid acceleration devices to maintain fiber tension and draw force through the lower end of the draw system. Alternative fluid acceleration devices such as a NASA profile convergent-divergent nozzle or other fluid acceleration means can also be used.

The draw jet extension has an adjustable slot and venturi width to control draw velocity and maintain constant tension on the filament cascade. The draw jet extension's distance above the foraminous collector belt is also adjustable.

Below each venturi is an additional set of adjustable inlet jets on both sides which may be used to suck in ambient fluid thereby creating a series of micro-vortices in the wall boundary layer. This creates a turbulence at the wall between the first venturi and the second venturi and after the second venturi prior to the exit into the fluid volume control diffuser system.

The fluid volume control diffuser system consists of two perforated plates oppositely situated and variable, as to angle, open area and vertical length. The major axis length of the perforated holes ranges from 2 millimeters to 150 millimeters. Each row may have holes with different major and minor axis length. The fluid scoop portion of the hole is elevated above the surface of the diffuser plate. The plates depend from the bottom of the draw jet-slot extension assembly and which lower adjustable ends may be abutted to vacuum seal rollers or other sealing means, or open to the atmosphere.

In the case where the plates are open to the ambient atmosphere the ends of the plates are adjusted to the correct distance above the foraminous belt. The distance of the two plate ends above the foraminous belt may be equal or unequal.

Generally in the case where the ends of the plates are open to the ambient atmosphere the deposition of fibers is more uniform if the longer plate is on the up stream side in reference to the belt travel direction.

These plates contain a multiplicity of fluid holes which are controllable as to total area by the use of a slide gate or other means. The holes or amount of open area controls the amount and pressure of fluid in the diffuser and controls turbulence but allows the ambient fluid to be automatically entrained. This has a beneficial effect on the uniformity of filament lay down by controlling the rate of deceleration of the filaments.

The filaments begin to decelerate upon entry into the fluid control system and begin to describe a downward spiraling motion which assists in developing a uniformly isotropic web deposited on the foraminous conveyor belt used to receive and convey away the web. The fluid volume control system is adjustable as to the diffuser angle and open area.

When the included angle between the two halves is wide the swirl approaches an elliptical appearance with the longer axis in the machine direction. Narrowing the included angle shifts the elliptical pattern to the cross direction. Proper angle and fluid flow adjustment of the fluid volume control diffuser is based on belt speed and required areal web weight so that the resultant swirl pattern on the moving belt is most nearly circular. A circular pattern provides the most isotropic product physical characteristics wherein the machine to cross direction ratios of physical properties such as tensile strength and elongation approach a ratio of 1:1. This is significantly better than typical spunbond fabrics which generally have ratios in the 2:1 or higher range especially at low areal weights and high belt speeds. The narrower ratio permits lighter weight fabrics to be safely used in applications such as disposable diapers where cross direction tensile strength is an important consideration from both the diaper manufacturing and end use requirements.

In order to maintain complete and total control of the system fluid and also reduce the load on the under belt suction device it is necessary to prevent the incursion of ambient fluid into the space between the outlet of the diffuser system and the belt as well as between the belt and the plenum.

This is accomplished by creating a sealing system where the lower end of each fluid volume control diffuser system plate assembly is affixed to a curved surface which is slidingly adjoined to a set of upper vacuum seal rolls. This effectively seals the control system against fluid being sucked in at the lower edges of the volume control system thus minimizing any possible turbulence which might interfere with filament lay down. The curved surface is designed such that surface is continually in sliding contact with the surface of the stationary vacuum seal rolls. regardless of the angle of the diffuser system. The curved surface or shoe is covered with a replaceable low pile fabric to aid in sealing. Alternatively the rolls may be covered with fabric.

The two above the belt sealing rolls are paired with two below the belt sealing rolls in order to provide an essentially leak proof connection between the diffuser ends and the upper opening to the vacuum plenum. The lower sealing rolls are also slidingly sealed to the plenum. The lower or suction opening of the vacuum plenum is connected to a variable volume suction blower or other variable volume suction pressure device by a duct.

To decrease the web thickness prior to the deposition of an additional web or the web bonding step it is compacted by a driven web compaction roll set directly after leaving the vacuum area.

The variable speed foraminous collector screen or belt then delivers the web or multiple webs to a filament bonding station, such as thermal pattern bonding or other means of web bonding or interlocking.

It is anticipated that this unique spunbond system will be used in combination with a meltblown system and a second unique spunbond system to provide a unique in-situ three web laminate. It is further anticipated that this unique spunbond system will be used in combination with a meltblown system to provide a unique in-situ two web laminate.

It is further anticipated that using the instant invention, spunbond fabrics with average filament sizes below 0.7 denier will have, opacity, resistance to liquid penetration and other physical and performance properties comparable to SMS webs.

Glossary Of Terms

In order to better understand the terminology used herein, particularly those terms which may be ambiguous with respect to some prior art or which have been indiscriminately used without explanation in the prior art, the following definitions are submitted.

Aspirate: to draw by suction

Aspirative means: a means by which an internal force such as a suction or differential pressure sucks or draws fibers or fluid through a passage or slot Buffer zone: see quench fluid extraction zone Capillary: refers to the resin extrusion orifice or any other drilled hole or perforation that serves as an orifice Crystallinity: the relative fraction of highly ordered molecular structure regions compared to the poorly ordered amorphous regions as determined by X-ray or other appropriate analytical means Die head: refers to complete structure containing the spinnerets, resin distributors and other associated filament extrusion equipment and which extends across the full width of the spunbond machine, also referred to as a die beam Diffuser: a diverging channel transition system for controlled reduction of the velocity of the fluid and filaments exiting the filament drawing system and entering the filament lay-down system Educt: to draw out Eductive means: a means by which an external force such as a suction fan creates a differential pressure that draws fibers or fluid out through a passage or slot Fluid volume control plate open area: the ratio of the actual area of the holes as precluded by the slide control plate to the total area of the fluid-scoop holes Induct: to bring in Inductive means: a means by which an external force such as a pressure fan creates a differential pressure that transports or brings fibers or fluid into or through a passage or slot Infuser: a converging channel transition system for controlled funneling of fluid and filaments into the filament drawing system Jet: a slot, nozzle, perforation or other orifice through which a fluid may be emitted or drawn in and which may have an opening that is round, rectangular, or any other shape without regard to length or diameter MD/CD ratio: ratio of a fabrics machine direction to cross direction properties typically used as a measure of isotropic formation Quench fluid extraction zone: That portion of the area between the quench cabinets where the bilateral quench fluid streams meet and descend into the fluid volume control infuser Resin: refers to any type of material that may be liquefied to form fibers or nonwoven webs including, without limitation, polymers, copolymers, thermoplastic resins, waxes, emulsions and the like

BRIEF DESCRIPTION OF THE DRAWINGS

The above and other objects, features, and advantages will become more readily apparent from the following description, reference being made to the accompanying drawing in which.

DETAILED DESCRIPTION

The invention is described in connection with preferred embodiment, however it should be understood that it is not intended to limit the invention to those embodiments. On the contrary, it is intended to cover all alternatives, modifications and equivalents as may be included within the description as well as within the spirit and scope of the invention as defined by the appended claims.

Figure 1:
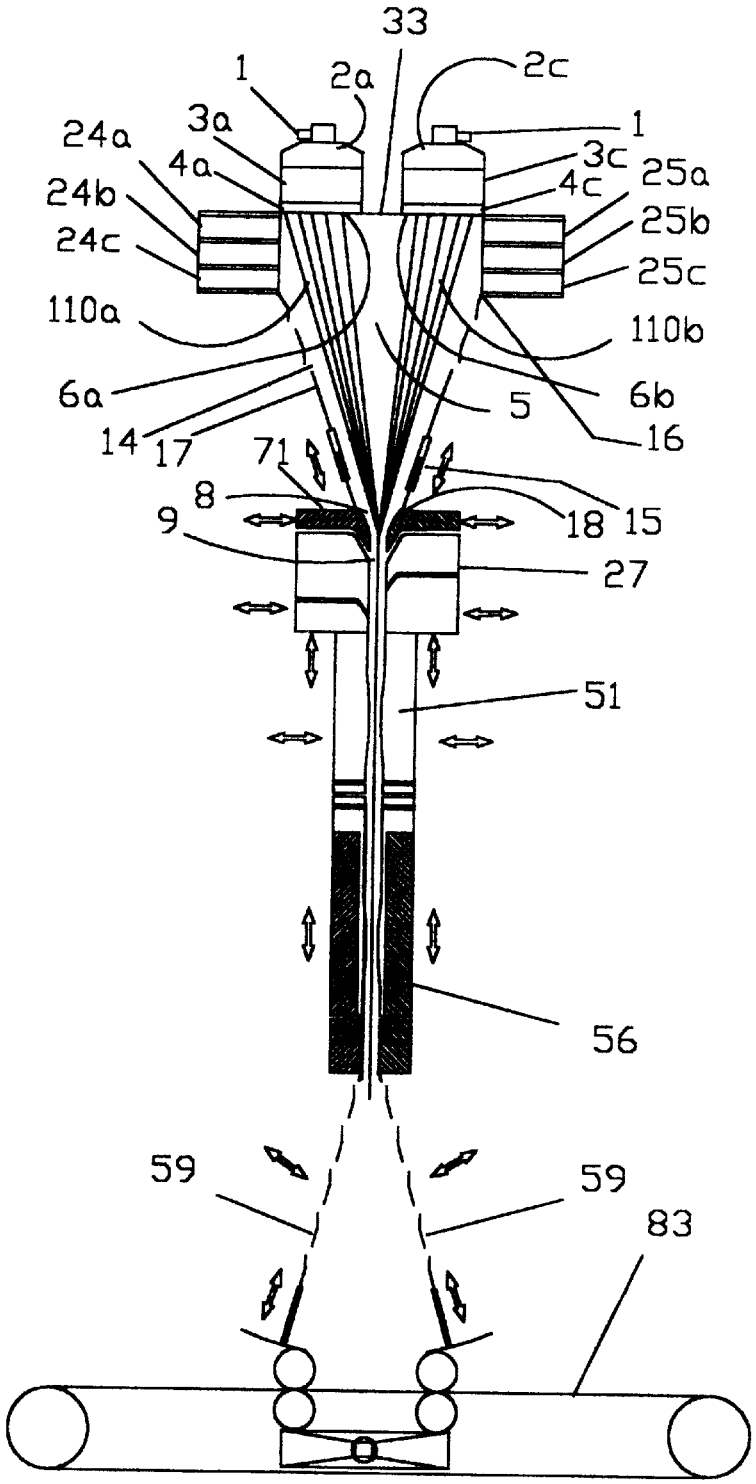
FIG. 1 is a vertical cross section through one embodiment of the apparatus of the invention.

The apparatus shown in FIG. 1 generates a continuous spun-bond web from aerodynamically stretched filaments of a thermoplastic synthetic resin. Molten thermoplastic resin produced by an extrusion device (not shown) enters the inlets 1 to the pressurized fluid metering system 2*a*, 2*c* for distribution to the parallel micro-coat hanger distribution systems 3*a* & 3*c*. The pressurized fluid metering system is unique in that each pressurized fluid metering device has 2 or more individual outlets or in the instant case 6 outlets. Each individual pump outlet feeds an individual micro-coat hanger or three dimensional fluid distributor The micro-coat hanger distribution system systems 3*a* & 3*c* feeds the spinnerets 4*a*, 4*c*.

A unique aspect of the micro-coat hanger melt extrusion distribution system is that each coat hanger is supplied resin from an individual feed supply and feeds only from 50 to 250 millimeters of die length. In the instant embodiment each coat hanger feeds 100 millimeters of die length. This insures precise control of the amount of resin reaching the filament extrusion orifices. Consequently the flow rate at each orifice is very consistent, and along with the other inventions that make up this process and its resulting web product, results in a very narrow range of filament diameters at a given set of conditions with a specific orifice diameter.

Figure 2:
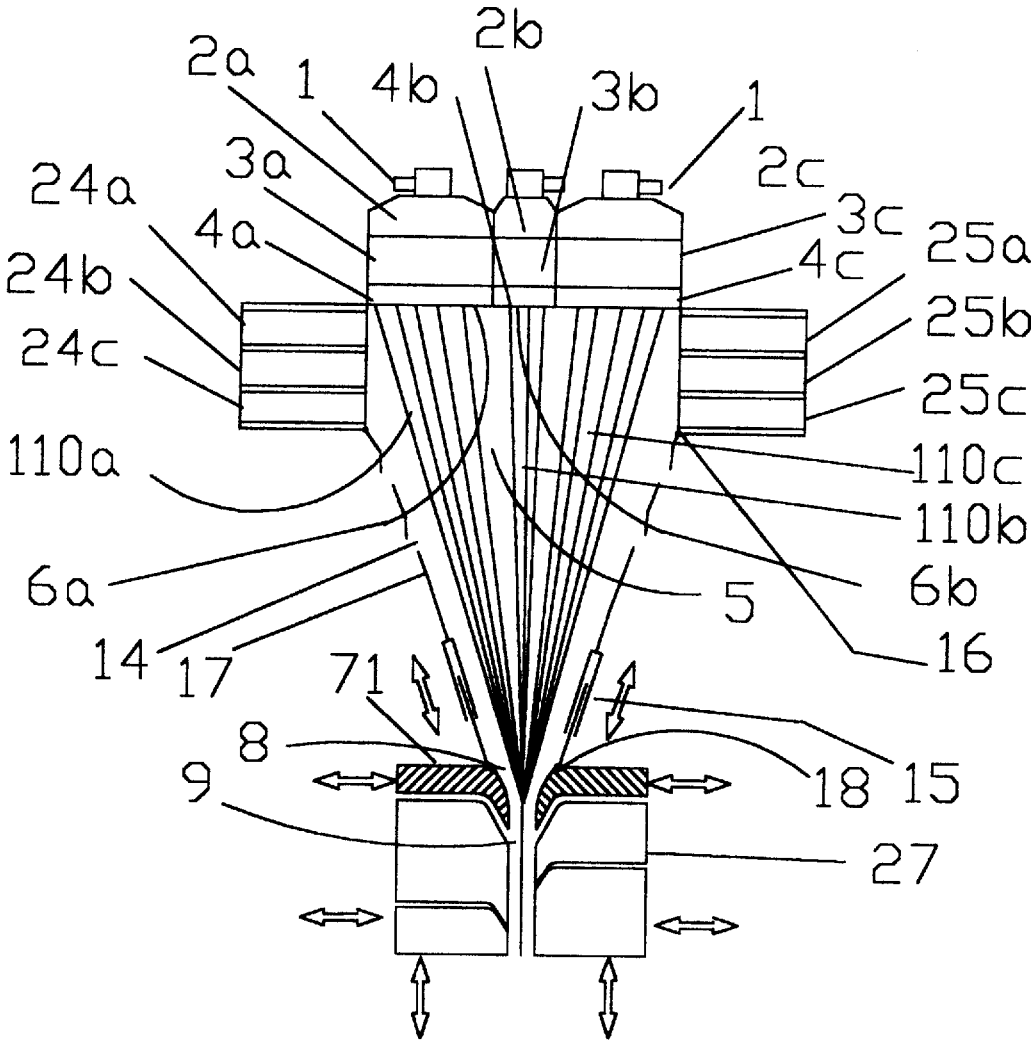
FIG. 2 is vertical cross section through a second embodiment of the apparatus of the invention.

The spinneret head with its dual spinning sections 4*a*, 4*c*, is separated by a buffer segment and quench fluid extraction zone. 5. Two cascades of filaments 110*a*, 110*c* emerge from the discrete spinnerets 6*a, c* and are contacted with quench fluid from the quench process fluid manifolds. The number of spinning orifices or capillaries per centimeter of cross directional die width is more than fifty percent greater than conventional spunbond dies. In the spinneret head the space 33 between the two spinneret sections 4*a* and 4*c* provides a buffer zone 5 to prevent left and right side quench fluids from impinging on each other within the dense filament curtains descending from the two spinneret sections. It was previously discovered impingement of the opposing fluid streams in the buffer zone was not an issue if the filament density in the buffer zone was about eighty percent or less of the filament density in the dual spinning sections. The buffer zone can then, alternatively, be used to provide additional die holes in the spinneret. FIG. 2 shows the apparatus with a lower density spinning segment 4*b*. The low density filament curtain 110*b* is shown leaving discrete spinneret 6*b*. Also shown is the additional pressurized fluid metering system 2*b*, for distribution to the parallel microcoat hanger distribution system 3*b*. The capability to use more holes per meter of die width permits even higher overall throughput per meter and further reduces the loss of throughput when producing low and sub-denier fibers. The uniform quenching promotes an extremely narrow and uniform drawn filament diameter range. This is an important factor not present in the prior art. The buffer zone with and without the low density perforations also provides a non-turbulent turning region for the quench streams to combine and be entrained in the downward movement of the filament cascade.

The quench fluid system which consists of two opposed assemblies of at least three individual manifolds zones 24*a, b* & *c*, 25*a, b* & *c* each of which operates at an individually controllable volume and temperature. The fluid volume and temperatures in each section may be controlled so that any temperature sequence, within the controlled range, may be attained thus, for instance, enabling a delayed quench or a warm annealing step to be followed by a cold quench. This is a necessary step in making high tenacity fibers from materials such as polyester or other materials with distinct glass transition temperatures ($T_g$). The opposed and separate nature of dual spinnerets and separately controlled bilateral quench also permits the use of two different but compatible resins, one on each side, or a differentially quenched bicomponent filament. The quench fluid is required for the solidification and crystallization process of each filament leaving the spinnerets 6*a*, 6*b*. In the instant invention each quench stream of the three quench fluid manifolds on each side delivers quench fluid at an individually controlled temperature ranging from 20° F. to 200° F. Each of the three quench fluid zones 24*a, b* & *c*, 25*a, b* & *c* is separately temperature controlled by temperature control means. The quench fluid is delivered to the unit by a pressurized fluid system which may have one or more blowers and one or more heat exchangers, each with its own pressure control allowing precise independent adjustment of the quench velocity within the range of 30 to 1000 meters per minute depending on the specific resin, mass throughput and other process requirements.

Figure 3A:
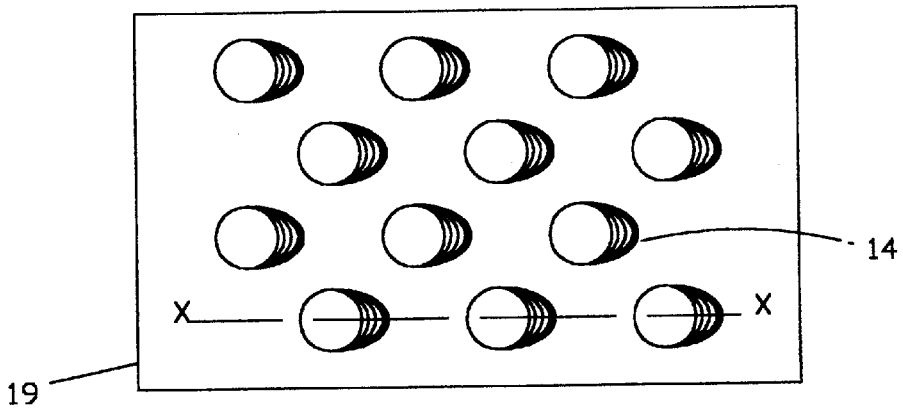
FIG. 3*a* is a plan view of a fluid scoop plate of the volume control system
Figure 3B:
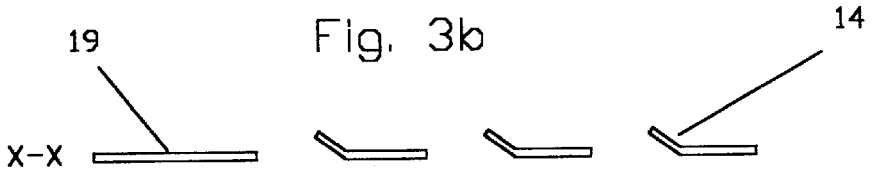
FIG. 3*b* is a side sectional view (X—X) of a fluid scoop plate of the volume control system
Figure 4A:
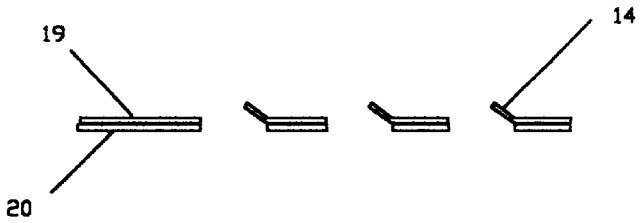
FIG. 4*a* is a side view of a fluid scoop plate of the fluid volume control system showing the arrangement of the volume adjustment plate in the fully open position
Figure 4B:
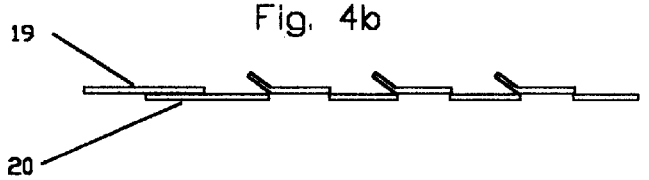
FIG. 4*b* is a side view of a fluid scoop plate of the volume control system showing the arrangement of the volume adjustment plate in the fully closed position
Figure 4C:
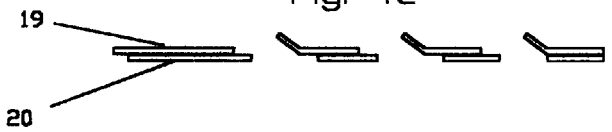
FIG. 4*c* is a side view of a fluid scoop plate of the volume control system showing the arrangement of the volume adjustment plate in the partially open position

After quenching, the filaments descend through an adjustable fluid volume regulation system or fluid volume control infuser system 17 which depends from the lower inner edges of the quench system to the draw jet-slot inlet 8 of the draw jet assembly 27. The fluid volume control infuser system consists of two opposed specially perforated fluid regulation plates 19 as shown in FIGS. 3 & 4. The reversed fluid-scoop type perforations 14 permit excess quench fluid to automatically bleed off into the atmosphere based on the fluid pressure difference across the plate assembly. The major axis length of each perforation is from 2 millimeters to 150 millimeters.

The open area of the adjustable specially perforated fluid regulation plates ranges from 5 percent open to 100 percent open. The preferred range is 20 percent to 80 percent. In the instant example open area was 60 percent. This is based on the total area of all the holes in the plate. Total open hole area can range from 10 percent to 70 percent of the perforated area of the plates. The holes are located in the upper portion of the plates. Up to 90 percent of the vertical height may be perforated. In the instant example the perforated portion was 80 percent.

Each perforated plate's length is adjustable by a slide means 15 in the vertical direction in order to accommodate the relative changes in the distance between the lower surface of the quench system 16 and the upper surface 71 of the draw jet-slot assembly to which its lower edges are attached 18. This angle can be between 20 and 120 degrees. The perforated plate 19 assemblies also contain a flat perforated slide valve plate 20 of FIG. 4, the perforations of which normally index with the reversed fluid-scoop type perforations of the fluid regulation panels which gives a full open system. Both lateral ends of the V-shaped channel created by the adjustable fluid regulation system are closed by an adjustable sealing means.

Figure 7A:
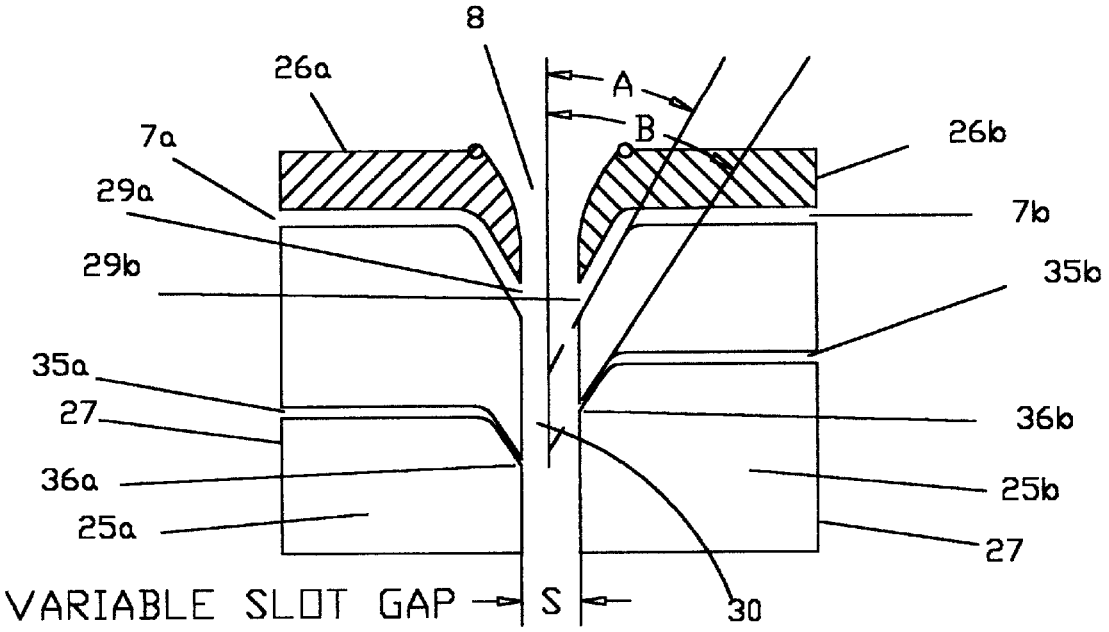
FIGS. 7*a* and 7*b* are vertical cross sections through the draw jet-slot assembly of the apparatus in detailed form.
Figure 7B:
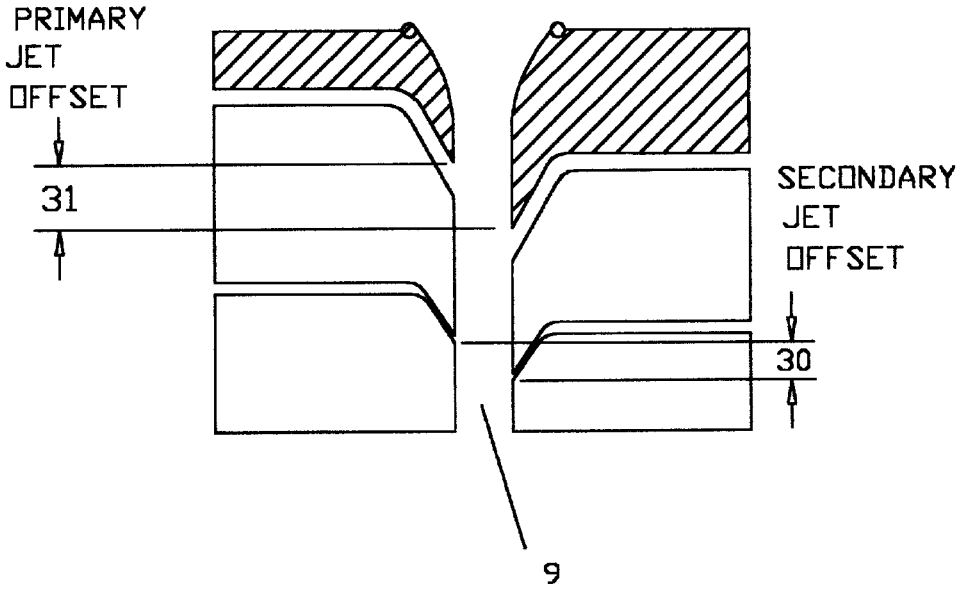

The filament draw system FIG. 1 consists of a draw jet assembly 27 that contains a variable width draw jet-slot 9 and variable width draw jet-nozzles 29*a, b*. FIG. 7*a* and 7*b*. The assembly consists of a right and a left hand vertical halves 25*a, b* which are generally parallel. The right and left hand vertical halves are moveable horizontally in relation to each other by a screw adjuster system. The space between the left and right vertical halves defines the variable width draw jet-slot 9 used to vary drawing velocity. The variable jet-slot gap "S" FIG. 7*a*, is adjustable between about 1.0 millimeter and 15 millimeters and is generally constant over the vertical length between the entrance and exit of the draw jet-slot. The draw jet assembly 27 extends vertically downward to the draw jet extension and horizontally the width of the spinneret head. The upper surfaces of both the right and left hand halves of the assembly 25*a, b* contain moveable and precisely adjustable nozzle plates 26*a, b* that are moveable horizontally in relation to the slot wall and serve to define the variable width draw jet-nozzles 29*a, b*. FIG. 7*a* shows the angle A formed by the center line of the primary jet-nozzle and the centerline of the draw jet-slot is 15 degrees. The draw jet assembly 27 is also moveable by a hydraulic, or screw jack system in order to adjust the distance between the spinnerets and the draw jet-slot entrance.

The variable orifice jet-nozzles 29*a, b*. formed by the adjustable nozzle plates and the upper edges of the vertical halves 25*a, b* provide very high velocity motive fluid for the drawing process extend the full horizontal width of the draw jet-slot, which with the fluid pressure and temperature control of the variable pressure blower and heat exchanger provides precise regulation of the drawing fluid velocity and temperature. The angle A of the draw jet-nozzles, as shown in FIG. 7*a*, with respect to the vertical has a broad range from about 5 degrees to about 60 degrees. The preferred range is 20 degrees±8 degrees. In the instant example the angle is 15 degrees. The gap of the variable orifice jet-nozzles 29*a, b* can range from about 0.5 millimeters to about 6 millimeters. The tempered fluid is supplied to the draw jet-nozzle's inlets 7*a*, 7*b* of FIG. 7*a* from the heat exchanger through a pressure equalizing distributor. The combination of precisely controlled quench fluid temperature and velocity permits each resin to be conditioned to the outer filament temperature required to optimize drawing in the slot and venturi sections.

After drawing fluid velocity is established the two halves 25*a, b* of the draw jet assembly 27 are adjusted to give the required jet-slot gap S of FIG. 7*a* to optimize the motive fluid velocity in the slot.

The distance of the surface of the draw jet assembly 27 from the lower surface of the spinnerets is adjustable from between about 400 millimeters and 1200 millimeters in order to maximize draw forces and filament attenuation which affect the reduction of filament denier and the increase in crystallinity.

The vertical ends of the variable slot 9 are closed at their lateral or cross machine ends by an adjustable sealing means.

As the filaments accelerate through the slot they pass between one or more opposed and offset secondary draw jet-nozzles 36*a, b* of FIG. 7*a*. The offset jets create perturbations across the slot 9 which induce a sinusoidal motion of the filaments which expose a greater surface area of the filament to the fluid stream. This creates a higher drag coefficient which transfers a higher amount of energy to the filaments creating a higher filament speed which improves the reduction of filament denier.

The secondary jet-nozzles, which may also have an adjustable gap, are offset vertically by a centerline distance of from 1 millimeter to 50 millimeters. In the instant example the offset was 20 millimeters. The angle "B" in FIG. 7*a* formed by the centerline of the secondary jet-nozzle and the centerline of the draw jet-slot ranges from about 2 degrees to 45 degrees. The preferred angle of impingement ranges from 10 degrees to 20 degrees. In the instant case the angle was 15 degrees. A variable speed blower and heat exchanger supply the high pressure, temperature controlled fluid used to provide the motive force.

Alternatively, one or more opposed secondary jet-nozzles 36*a, b*. can be fed by high pressure fluid from a blower that has been sent to a variable speed rotating splitter (three way) valve (not shown) which alternates pressurized fluid between inlets 35*a, b*. This provides alternate pulses between jets 36 a and b which also induces a sinusoidal motion of the filaments with a sharp increase in filament velocity.

FIG. 7*a* shows the angle B formed by the centerline of the secondary jet and the centerline of the draw jet-slot is 15 degrees in this embodiment. The broad range of the jet angle B formed by the centerline of the secondary jet and the centerline of the draw jet-slot, with respect to the horizontal axis, is from about +80 degrees to about 0 degrees. The secondary jet-nozzle gap 36*a, b* range from about 0.5 millimeter to about 6 millimeters.

An alternative method shown in FIG. 7*b* for creating a sinusoidal motion of the filaments within the slot is to offset the variable primary jet-nozzles 29*a, b* horizontal centerlines vertically 31 by between about 2.0 millimeters to about 20 millimeters as a broad range with 3.0 millimeters to 10 millimeters as the favored range.

Figure 5:
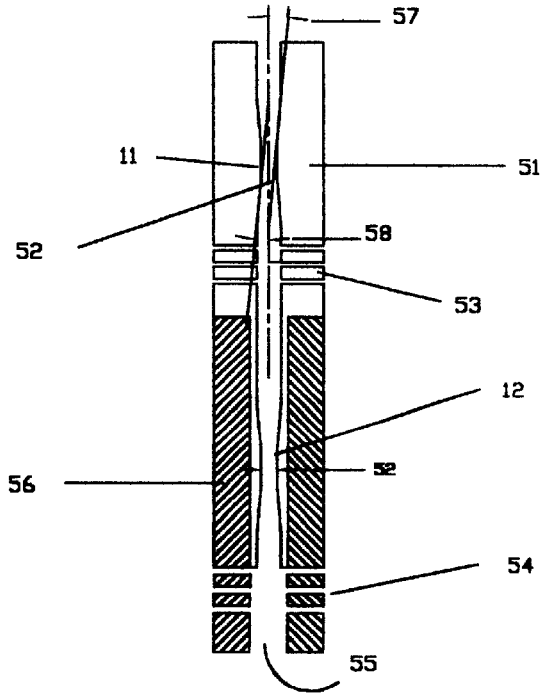
FIG. 5 is a detailed view of the supplemental draw jet slot extension and fluid acceleration devices

Filaments then enter the supplemental draw jet slot extension system 51 shown in FIG. 5. The adjustable slot extension depends vertically downward from the lower surface of the draw jet assembly 27, to which it is slidingly affixed to permit horizontal slot and venturi adjustment. The slot width of the draw extension is adjustable by means of a screw adjustment. The gap is adjustable between about 1.0 millimeter and about 15 millimeters and is generally constant over the vertical slot between the entrance and exit of the draw jet assembly. In the instant example the gap is 4 millimeters. This slot contains a first venturi 11 or other fluid acceleration means to further increase fluid velocity and prevent any loss of filament velocity in the system and maintain constant tension or increasing tension, on the filaments. The half angle of approach 57 to the venturi as shown in FIG. 5, ranges from about 1 degree to about 15 degrees whereas the half angle of recession 58 is from about 1 degree to about 17 degrees. In the preferred embodiment the angles are 3 degrees and 5 degrees respectively.

The venturi gaps 52_range from between about 1.0 millimeter and about 10 millimeters. The ratio of the venturi gap to the slot width in the draw jet extension ranges from about 0.95 to about 0.3. In the instant invention the venturi gap is 3 millimeters.

After leaving the first venturi there is a set of adjustable inlet apertures 53 on both sides of the slot that are used to create a series of micro-vortices in the wall boundary layer. This creates a minor degree of turbulence in the boundary layer prior to the second venturi.

Subsequent to the first set of adjustable inlet apertures 53 is a second venturi 12 or other fluid acceleration means to prevent any loss of filament velocity in the system thereby continuing to maintain tension on the filaments. The half angle of approach to the second venturi 12 ranges from about 1 degree to 10 degrees whereas the half angle of recession is from 1 degree to 17 degrees in the preferred embodiment the angle are 3 degrees and 5 degrees respectively. This venturi is also variable in width. The second venturi gap 52 ranges from between about 1.0 millimeter and about 10 millimeters. The ratio of the venturi gap to the slot width in the draw jet extension ranges from about 0.3 to about. 0.95.

Below the exit of the second venturi is an additional set of adjustable inlet apertures 54 on both sides of the slot that are used to create a series of micro-vortices in the wall boundary layer. This creates a minor turbulence in the boundary layer prior to the point at which the draw jet extension slot width increases due to the adjustable length means 56 and near the end of the draw jet extension immediately prior to the exit 55 into the fluid control system.

The slot extension's length is adjustable in the vertical plane by a sliding means 56 to accommodate the changes in elevation created by optimizing the distance of the draw jet assembly from the spinneret lower surface and optimizing the distance of the lower fluid control diffuser system from the surface of the collector. The width of the slot and venturi in the slot extension is also variable through horizontal adjustment means for further optimization of filament velocity.

Figure 6:
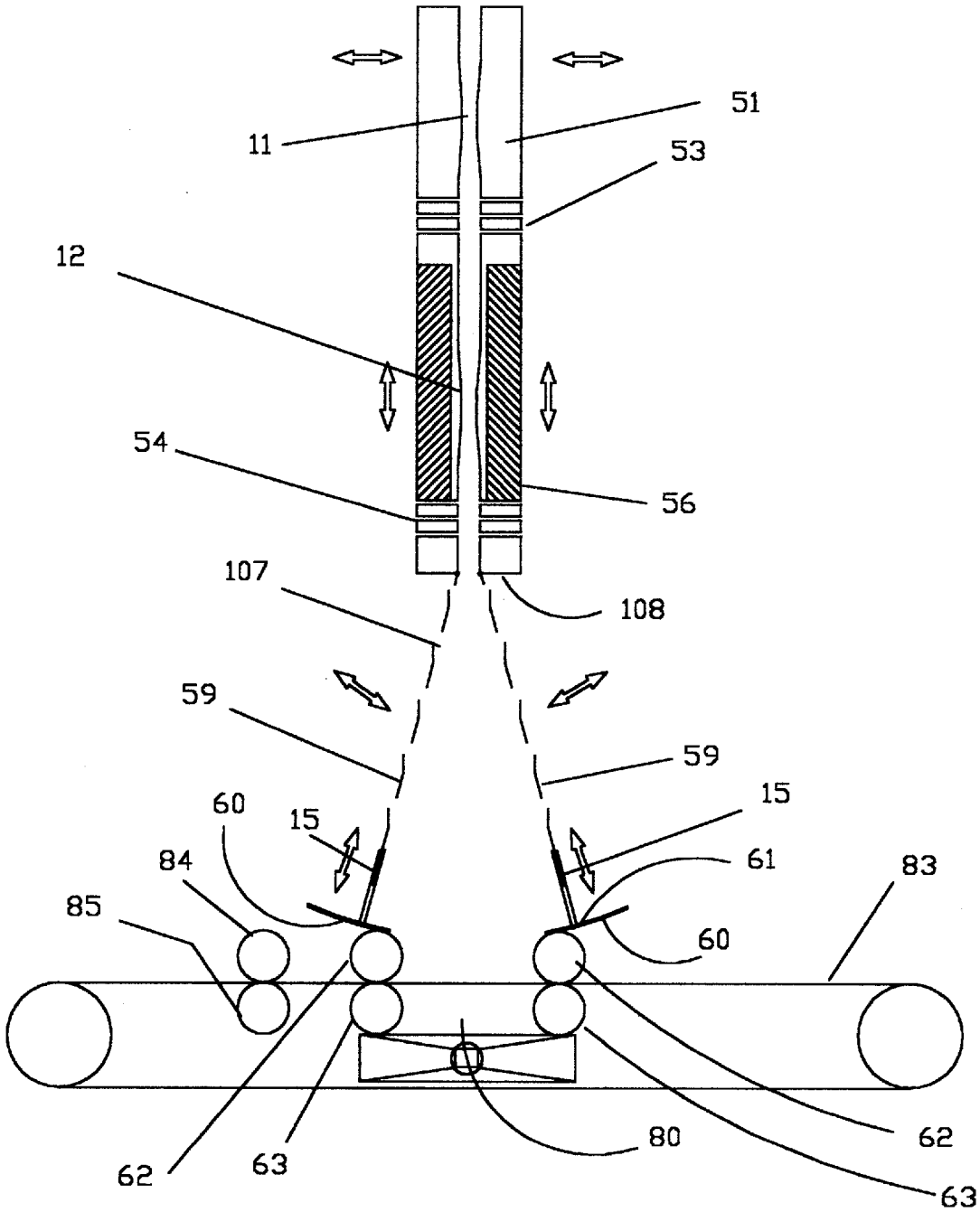
FIG. 6 is a detailed view of the supplemental draw jet slot extension, lower volume control plates, and lower volume control plates sealing system.

Depending from the lower slot extension is the adjustable fluid regulation system diffuser or volume control diffuser system which consists of an assembly of two opposed specially perforated fluid volume control plates FIG. 6.

Each perforated plate is adjustable by a slide means 15 in the vertical direction in order to accommodate the relative changes in the distance between the lower surface of the supplemental draw jet slot extension system 108 and the surface of the seal rolls 62. The included angle of the perforated plates of the diffuser assembly is adjustable, by an adjustment screw from 5 degrees to 120 degrees, measured from the vertical axis, as required to optimize fiber lay down and maximize the formation of isotropic properties within the web. Adjacent and coterminous with the fluid-scoop type perforated plate 19 lies a flat perforated slide valve plate 20, the perforations of which normally index with the fluid-scoop type perforations of the fluid regulation plates. Taken together they are referred to as the fluid volume control plate assembly. Lateral movement of slide valve plate 20 gradually occludes the air scoop perforations 107 and reduces the fluid flow in or out of the adjustable fluid volume control system diffuser as process operating conditions require.

The purpose of the lower adjustable fluid volume control system is to permit ambient fluid to automatically bleed into the diffuser depending on the fluid pressure difference across the plate and simultaneously prevent turbulence at the exit of the draw slot while maximizing the randomness of filament distribution on the foraminous web collection system which will permit the formation of near isotropic physical properties within the web. The adjustment features of the diffuser also permit optimization of filament distribution and physical properties regardless of collector speed.

The adjustable open area of the adjustable specially perforated fluid regulation plate assemblies ranges from 5 percent open to 100 percent open based on the total area of all the holes in the plate assembly. Total open hole area can range from 10 to 60 percent of the perforated area of the plates. The preferred range is 20 percent to 80 percent. In the instant example open area was 60 percent. The major axis length of each perforation is from 2 millimeters to 150 millimeters. The holes are located in the upper portion of the plates. The portion of the plate that is perforated ranges between 20 percent and 90 percent of the vertical height of the plate. In the instant example perforated portion was 80 percent.

The lower end 61 of each fluid volume control diffuser system plate assembly 59 is affixed to a curved surface 60 which is slidingly adjoined to the upper vacuum seal rolls 62 and effectively seals the control system against fluid being sucked in at the lower edges of the volume control system thus minimizing any possible turbulence which might interfere with filament lay down. The curved surface 60 is designed such that surface is continually in sliding adjoinment contact with the surface of the vacuum seal rolls thus the rolls can remain fixed in horizontal position. The curved surface is covered with a replaceable low pile fabric to aid in sealing.

A vacuum plenum 80 connected to variable suction pressure means is located beneath the surface of the variable speed foraminous collector screen 83 which runs between the upper 62 and lower 63 vacuum seal rolls. The two upper belt sealing rolls are oppositely and directly paired with two lower belt sealing rolls in order to provide an essentially leak proof connection between the diffuser ends and the vacuum plenum which is attached by duct to a controllable suction blower (not shown).

The web is compacted by a driven web compaction roll set 84 & 85 after leaving the vacuum area.

The variable speed foraminous collector screen or belt 83 then delivers the web to a filament bonding station, such as thermal pattern bonding or other means of web bonding or interlocking.

PROCESS EXAMPLES

The following experiments and the overall resultant data, as shown in Tables 1 through 6 below, demonstrate the intimate interrelationship between the apparatus, the process and the final spunbonded product.

The compound and synergistic effects of the multiple draw jets, multiple venturis, fluid volume control infuser and diffuser on high speed attenuation and production of a unique spunbond material are shown in Table 1 in accordance with the process of the present invention.

A one meter wide laboratory system with interchangeable central segments, one non-perforated and one with a 40% perforation density, was used for the following experiments. Using polypropylene with a 35 melt flow index the extrusion system and draw jet system was adjusted or modified to the various process conditions and settings shown in Tables 1, 2, 3, and 4. For those conditions not specifically shown therein the conditions and settings as shown in Table 5 were generally used.

The process tests shown in Table 1 were run using both alternative die heads. No substantive differences were found between the 40% perforation-density central segment and the non-perforated central segment as far as process and product performance was concerned with the exception of the expected higher total throughput when using the 40% perforation-density central section.

The first experiment, designed to evaluate component stage efficiency, was conducted by starting out with only the fluid volume control infuser assembly, the draw jet assembly, and the supplemental draw jet extension without venturis. Only the primary draw jet-nozzle or first draw jet-nozzle was used. In each subsequent experiment a different component of the invention was added and tested. Fiber velocities and filament diameters were checked for each experimental run. Each new component that was added was run at the same conditions shown in Table 5. The filament curtain extruding from the spinnerets was captured in the draw jet slot at an initial slot setting of 4 millimeters. This was gradually decreased to 2 millimeters to obtain minimum fiber diameter as determined by measuring fiber diameters using a microscope. Simultaneously with narrowing of the slot the draw jet assembly was elevated from its start-up position of about 1000 millimeters below the bottom of the spinneret to about 500 mm. The point was determined by spinning performance and minimum denier obtainable. These data were used as a baseline for further incremental testing of the remaining components.

The next step was to turn on the secondary draw jet-nozzles. The secondary jet-nozzles were positioned 20 millimeters below the primary jet and one offset 3 millimeters. Fluid volume was increased until the denier was minimized. This step had the remarkable effect of increasing fiber velocity by 35 percent and reducing average denier by 32 percent.

At this point a draw jet extension with one venturi was attached to the base of the draw jet assembly. After reaching process equilibrium fiber denier was optimized by making minor adjustments to the fluid flow of the primary and secondary jet-nozzles. The draw jet extension slot gap was set at 3.8 millimeters and the first venturi gap was set at 2 millimeters.

Next, the single venturi draw jet extension was replaced with a dual in-line venturi draw jet extension. After reaching process equilibrium fiber denier was optimized by making minor adjustments to the fluid flow at the primary and secondary jet-nozzles. The draw jet extension slot gap was set at 3.8 millimeters and the primary and secondary venturi gaps were set at 2 millimeters.

The data showed that there was a significant fiber velocity increase and corresponding significant filament denier decrease with the addition of each additional component. The total overall improvement compared to the base case fiber velocity was nearly 46 percent. The highest single component stage improvement was a 35 percent improvement between draw jets 1 and 2. This is believed to be primarily due to the greater horizontal cross-section filament surface area exposed to the drawing fluid due to the oscillation of the filament curtain and secondarily to the higher draw fluid velocity due to higher volume. The velocity increase between subsequent sections was smaller but the gross effect was an increase of almost 10 percent which resulted in a 4 percent decrease in denier.

In further testing the sub-denier fabrics were examined for opacity and hydrophobicity. Both properties were found to be from 20 percent to 70 percent higher than the typical 14 gram per square meter spunbond fabrics because of the instant inventions greater uniformity, cover and sub-denier fibers. Disposable diaper fabric was not used as the reference fabric in order to eliminate low hydrophobicity results caused by the addition of surfactants.

The end product result using all of the draw line components was a very uniform 14 gram per square meter web having an average filament denier of 0.85, excellent fabric tenacity, greatly improved hydrophobicity and excellent opacity. Output of resin was in excess of 0.9 grams per hole per minute at an average denier of 0.85 and in excess of 1.2 grams per hole per minute at an average denier of 0.98.

TABLE 1

Effect Of Drawing Section Apparatus Components On Fiber Velocity And Denier

| Run # | 1 | 2 | 3 | 4 | 5 |
|---|---|---|---|---|---|
| Components used | Infuser<br>Draw jet 1 | Infuser<br>Draw jet 1<br>Draw jet 2 | Infuser<br>Draw jet 1<br>Draw jet 2<br>Venturi 1 | Infuser<br>Draw jet 1<br>Draw jet 2<br>Venturi 1<br>Venturi 2 | Infuser<br>Draw jet 1<br>Draw jet 2<br>Venturi 1<br>Venturi 2<br>Diffuser |
| Fiber velocity @ ext. exit (M/min.) | 4900 | 6600 | 6800 | 6950 | 7150 |
| Fluid to Fiber Velocity Ratio | 3.2 | 2.5 | 2.4 | 2.4 | 2.3 |
| Velocity increase from prior stage % | | 34.7 | 3.0 | 2.2 | 2.9 |
| Total Fiber Velocity Increase (Runs 1 to 5) % | | | | | 45.9 |
| Filament Denier Average | 1.36 | 0.90 | 0.88 | 0.87 | 0.85 |
| Fabric Weight ($G/M^2$ | 14 | 14 | 14 | 14 | 14 |
| Fabric Tenacity MD | 51 | 48 | 49 | 48 | 48 |
| Fabric Tenacity CD | 45 | 43 | 42 | 41 | 42 |
| Relative Opacity (% greater than) (compared to 2.5 denier 14 gsm commercial SB) | 24 | 42 | 43 | 44 | 51 |

In a second test series data was gathered on the effect of diffuser open area and diffuser angle settings on the spunbond uniformity as measured by MD/CD strength ratios. Testing was done at three different collector belt speeds.

The volume control diffuser system plate assembly angles were set between 10 degrees and 40 degrees with a collector belt speeds of 300 meters to 600 meters per minute. Diffuser open area was varied between 30 percent and 70 percent. Diffuser plate assembly vertical length was 500 millimeters. All other process conditions and settings were either maintained or slightly adjusted through the test sequences.

The resultant data is shown in Tables 2, 3 & 4. The results showed that by changing the diffuser a surprisingly effective control was achieved over the deposition pattern of the filaments exiting the draw jet extension. By changing the angle of the diffuser's fluid volume control plates and their amount of open area the machine direction to cross direction ratio (MD/CD ratio) of fabric tensile strength can be altered to meet whatever ratio is required. In most cases a ratio of about one to one (1:1) is desirable. However in some case where higher cross direction strength is desirable, such as disposable diaper cover sheet, this can also be accomplished.

A further experiment was done using a commercial polyester having an intrinsic viscosity of 0.64. The results, shown in Table 6, showed that fiber denier was greatly reduced. Fabric uniformity as measured by MD/CD tensile properties showed improvements similar to the polypropylene data.

TABLE 2

Effect of Diffuser Angle Settings On MD/CD Ratio @ 300 M/min. Belt speed

| Run Number | 1 | 2 | 3 | 4 |
|---|---|---|---|---|
| Spinning speed (M/min) | 6000 | 6000 | 6000 | 6000 |
| Diffuser angle (degrees) | 10 | 20 | 30 | 40 |
| Diffuser Opening @ Belt (mm) | 88 | 176 | 268 | 364 |
| Belt Speed (M/min) | 300 | 300 | 300 | 300 |
| DOA* | MD/CD** | MD/CD** | MD/CD** | MD/CD** |
| 30 | 0.18 | 0.44 | 1.36 | 2.47 |
| 50 | 0.27 | 0.70 | 2.11 | 3.12 |
| 70 | 0.53 | 0.95 | 2.51 | 3.62 |

*Diffuser Open Area As % of Total Available Open Area
** Tensile Strength Ratio MD/CD

TABLE 3

Effect of Diffuser Angle Settings On MD/CD Ratio @ 450 M/min. Belt speed

| Run Number | 5 | 6 | 7 | 8 |
|---|---|---|---|---|
| Spinning speed (M/min) | 6000 | 6000 | 6000 | 6000 |
| Diffuser angle (degrees) | 10 | 20 | 30 | 40 |
| Diffuser Opening @ Belt (mm) | 88 | 176 | 268 | 364 |
| Belt Speed (M/min) | 450 | 450 | 450 | 450 |
| DOA* | MD/CD** | MD/CD** | MD/CD** | MD/CD** |
| 30 | 0.23 | 0.97 | 1.95 | 3.08 |
| 50 | 0.52 | 1.45 | 2.60 | 3.44 |
| 70 | 1.03 | 1.88 | 3.27 | 4.23 |

*Diffuser Open Area As % of Total Available Open Area
** Tensile Strength Ratio MD/CD

TABLE 4

Effect of Diffuser Angle Settings On MD/CD Ratio @ 600 M/min. Belt speed

| Run Number | 9 | 10 | 11 | 12 |
|---|---|---|---|---|
| Spinning speed (M/min) | 6000 | 6000 | 6000 | 6000 |
| Diffuser angle (degrees) | 10 | 20 | 30 | 40 |
| Diffuser Opening @ Belt (mm) | 88 | 176 | 268 | 364 |
| Belt Speed (M/min) | 600 | 600 | 600 | 600 |
| DOA* | MD/CD** | MD/CD** | MD/CD** | MD/CD** |
| 30 | 0.41 | 1.33 | 2.37 | 3.35 |
| 50 | 1.09 | 2.18 | 3.14 | 4.12 |
| 70 | 1.67 | 2.65 | 3.76 | 4.83 |

*Diffuser Open Area As % of Total Available Open Area
** Tensile Strength Ratio MD/CD

TABLE 5

General Process Settings

| Polymer | Type | PP | PET |
|---|---|---|---|
| Polymer | Viscosity | 35 MF | 0.64 IV |
| Polymer Melt Temp. | ° C. | 225 | 325 |
| Polymer Throughput | kg/hr/M | 340 to 460 | 340 to 460 |
| Orifices per meter of width | Number | 6200 | 6200 |
| Metering Pump Streams | Number | 16 | 16 |
| Quench Fluid Temp. #1 | ° C. | 7 | 8 |
| Quench Fluid Temp. #2 | ° C. | 9 | 8 |
| Quench Fluid Temp. #3 | ° C. | 12 | 8 |
| Quench Fluid Volume #1 | M3/min | 15 | 34 |
| Quench Fluid Volume #2 | M3/min | 7.5 | 17 |
| Quench Fluid Volume #3 | M3/min | 7.5 | 17 |
| Quench Fluid Volume Total | M3/min | 30 | 68 |
| Upper Control Plates Angle | Degrees. | 30 | 42 |
| Control Plates Hole Size | mm | 30 | 30 |
| Control Plates % Open | % | 30 to 70 | 50 to 90 |
| primary Draw Fluid Volume | M3/min | 38 | 46 |
| Primary Draw Fluid Pressure | Bar | 1 to 3 | 1 to 3 |
| Draw Fluid Temp | ° C. | 15 to 30 | 15 to 30 |
| Primary Jet-nozzle Gap | mm | 0.5 to 3 | 0.5 to 3 |
| Primary Jet-nozzle Angle | Degrees. | 15 | 15 |
| Secondary Jet-nozzle Gap | mm | 0.5 to 3 | 0.5 to 3 |
| Secondary Jet-nozzle Angle | Degrees. | 15 | 15 |
| Secondary Jet Fluid Volume | M3/min | 10 | 10 |
| Draw Jet-slot Gap | mm | 2 to 8 | 2 to 8 |
| Extension Slot Gap | mm | 2 to 8 | 2 to 8 |
| Extension Venturi #1 Gap | mm | 1.5 to 4 | 1.5 to 4 |
| Extension Venturi #2 Gap | mm | 1.5 to 4 | 1.5 to 4 |
| Lower Control Plates Angle | Degrees. | 10 to 40 | 10 to 40 |
| Control Plates Hole Size, diameter | mm | 30 | 30 |
| Control Plates % Open | % | 10 to 80 | 10 to 80 |

TABLE 6

Effect of Drawing Section On Polyester

| Run # | 17 |
|---|---|
| Components used | Infuser<br>Draw jet 1<br>Draw jet 2<br>Venturi 1<br>Venturi 2<br>Diffuser |
| Fiber velocity @ ext. exit (M/min.) | 7600 |
| Fluid to Fiber Velocity Ratio | 2.1 |
| Filament Denier Average | 0.85 |
| Fabric Weight (g/mm | 14 |
| Fabric Tenacity MD | 77 |
| Fabric Tenacity CD | 62 |

While preferred embodiments of the present invention have been described in the foregoing detailed description the invention is capable of numerous modifications, substitutions and deletions from the embodiments described above without departing from the scope of the following claims.

We claim:

1. Apparatus for the continuous production of a web of aerodynamically stretched sub-denier filaments from a liquefied resin, comprising:

means for generating a substantially continuous steady state flow of liquefied resin;

a spinneret die for extruding a multiplicity of continuous resin strands, said die having a front and a back segment each accommodating an array of perforated extrusion capillaries separated by a central segment wherein each segment extends the full working width of said spinneret die;

one or more pressurized liquefied resin metering means each having multiple distribution ducts wherein each of said ducts precisely meters resin to one of a series of three dimensional resin micro-distributors which reciprocally and uniformly transports said resin to the extrusion capillaries whereby each of said resin micro-distributors supplies a portion of the overall length of said spinneret die;

a means for creating high volume, pressurized quench fluid and a means for controlling said pressurized quench fluid temperature;

a quench fluid assembly consisting of two parallel and opposed quench means, each quench means located below and adjacent to the front and back outside edges of said spinneret die, each of said quench means containing at least two physically separate and independent zones wherein the temperature and velocity of each quench fluid stream is individually controllable according to process considerations;

a fluid volume control infuser system which minimizes turbulence at the entrance to a primary fiber drawing means and which comprises two oppositely situated fluid volume control plates which depend from the inner bottom edges of said quench fluid assembly and extend the full width of said quench assembly and are closed at both ends by an adjustable sealing means and wherein said volume control plates contain a multiplicity of air scoop shaped holes along their upper segments and whereby said volume control plates are controllable as to open area by use of an adjustable occluding means on said air scoop shaped holes and said volume control plates are variable with respect to their included angle, the total open area of all holes and the length from an upper attachment point on said quench assembly to said volume control plates lower attachment point on the entrance to said primary fiber drawing means;

separate adjustment means to control the angle between said volume control plates, the length of said plates, and open area of said plates;

said primary fiber drawing means comprising a vertically extending and horizontally elongated variable width draw-jet slot formed by an opposed pair of spaced and generally parallel but moveable vertical side walls wherein said vertical side walls, which have a top and a bottom, are moveable horizontally in relation to each other forming said variable width draw jet-slot and said primary fiber drawing means being vertically moveable by a height adjustment means to adjust the distance of said primary fiber drawing means from said spinneret die, two horizontally opposed and adjustable nozzle plates that are moveably fastened to the top of said vertical side walls, said adjustable nozzle plates coincidentally forming two opposed and variable opening primary draw jet-nozzles and the entrance to said slot wherein said primary draw jet-nozzles are oppositely situated, and a pair of spaced and generally parallel end walls which bridge the side walls to prevent end leakage and are horizontally moveable, wherein said fiber strands are drawn downward through said variable width draw-jet slot by the aerodynamic drag forces of a first collateral motive fluid stream provided by said draw jet-nozzles;

horizontally extending and continuous, secondary draw jet-nozzles, located in each vertical side wall of the drawing means and situated oppositely but vertically offset below said motive fluid primary jet-nozzles wherein said secondary draw jet-nozzles provide a second adjustable, continuous and controllable collateral fluid stream after passing through a pressure equalizing distribution means, said second stream emitting continuously from each opposed side wall of said drawing means;

a supplemental variable width draw jet slot extension assembly fixedly connected to said primary drawing means comprising a vertically extending and horizontally elongated process shaft having upper and lower ends, a pair of spaced and generally parallel but moveable side walls wherein each of said supplemental side walls are moveable horizontally in relation to each other forming said supplemental variable width drawing slot, wherein said supplemental slot has two in-line fluid acceleration means, each of said fluid acceleration means followed by a set of adjustable inlet apertures and a pair of spaced and generally parallel end walls which bridge the supplemental side walls and are horizontally moveable wherein said fiber strands are drawn continuously downward by the aerodynamic drag forces of the combined first and second collateral fluid streams, and a means to independently adjust the length of the lower part of said supplemental variable width draw jet slot extension assembly;

a variable web condensing system comprising an adjustable fluid volume control and balancing system diffuser, which depends from said supplemental draw jet slot extension assembly and comprises an assembly of two horizontally opposed and perforated fluid volume control plates, the angle of said perforated volume control plates being adjustable, and whereby said perforated plates are controllable as to open area by use of an adjustable occluding means across said perforations and said perforated fluid control plates are variable with respect to their included angle and the total open area of all perforations and wherein the lower ends of said perforated fluid control plates have a sealing means;

a variable speed, continuous, foraminous collector belt;

an under belt fluid collector system comprising a plenum with sealing means between said diffuser and a plenum inlet consisting of two spaced apart above-belt sealing rolls oppositely and directly paired with two spaced apart below-belt sealing rolls wherein said above-belt sealing rolls are in continuous sliding contact with the sealing means of said diffuser plate lower ends and said lower sealing rolls are in continuous sliding contact with the inlet end of said plenum; and a controllable volume suction means in direct communication with the outlet of said plenum.

2. The apparatus of claim 1 wherein the central segment of said spinneret die is non-perforated.

3. The apparatus of claim 1 wherein the central segment of said spinneret die has a perforation density about eighty percent or less of the perforation density of the front and back segments.

4. The apparatus of claim 1 wherein an angle of an impinging jet from said primary draw jet-nozzles is between 2 degrees and 30 degrees as measured from the vertical.

5. The apparatus of claim 1 wherein the metering means is one or more multiple outlet spin pumps.

6. The apparatus of claim 1 wherein each of said three dimensional spinneret micro-distributors feed no more than 100 millimeters of die width.

7. The apparatus of claim 1 wherein the machine direction length of said central segment of said spinneret die is at least 8 percent of the total machine direction length of said spinneret die and at least 20 percent of the total machine direction length of said front and said back perforated capillary arrays.

8. The apparatus of claim 1 wherein a control means is used for directing fluid alternately and at a variable frequency to each of said secondary fluid jet-nozzles.

9. The apparatus of claim 1 wherein said primary fluid jet-nozzles, formed by said two horizontally opposed and adjustable nozzle plates, are oppositely situated but off set vertically by a jet-nozzle centerline distance of from 1 millimeter to 50 millimeters.

10. The apparatus of claim 1 wherein an angle of incidence of said secondary fluid jet-nozzles as measured from the horizontal ranges from about 80 degrees to 0 degrees.

11. The apparatus of claim 1 wherein said secondary fluid stream is from a single secondary fluid jet-nozzle positioned on one side of said draw-jet slot wherein said fluid stream has a constant velocity.

12. The apparatus of claim 1 wherein said fluid holes and perforations in said fluid volume control system infuser and diffuser plates are located in no more than the upper 90 percent of said plates.

13. The apparatus of claim 1 wherein said included angle of said fluid volume control system infuser plates is between 20 degrees and 120 degrees.

14. The apparatus of claim 1 wherein said open area of said holes and perforations of said volume control plates of the infuser and diffuser is adjustable between 5 and 100 percent of the total open area.

15. The apparatus of claim 1 wherein a the major axis length of the holes and perforations in said volume control plates of said infuser and diffuser ranges between 2 millimeters and 150 millimeters.

16. The apparatus of claim 1 wherein said fluid acceleration means are converging-diverging nozzles.

17. The apparatus of claim 16 wherein a half angle of convergence into said converging-diverging nozzles ranges from about 1 degrees to about 15 degrees whereas a half angle of recession is from about 1 degrees to about 17 degrees.

18. The apparatus of claim 1 wherein said included angle between said diffuser plates is adjustable between 5 degrees and 120 degrees.

* * * * *